US005162607A

United States Patent [19]

Steiner

[11] Patent Number: 5,162,607

[45] Date of Patent: Nov. 10, 1992

[54] LONG ROD PENETRATOR

[75] Inventor: Edwin G. Steiner, York, Pa.

[73] Assignee: Olin Corporation, Cheshire, Conn.

[21] Appl. No.: 779,758

[22] Filed: Oct. 21, 1991

[51] Int. Cl.[5] ..... F42B 12/06; F42B 12/44

[52] U.S. Cl. ..... 102/364; 102/517; 102/521; 102/703

[58] Field of Search ..... 102/501, 514–519, 102/521, 703, 364

[56] References Cited

U.S. PATENT DOCUMENTS

| | | | |
|---|---|---|---|
| 41,668 | 2/1864 | Absterdan | 102/524 |
| 293,337 | 2/1884 | Mann | 102/524 |
| 2,386,054 | 10/1945 | McGee | 102/501 |
| 2,856,856 | 10/1958 | Michael | 102/526 |
| 4,444,118 | 4/1984 | Hoffmann et al. | 102/518 |
| 4,616,569 | 10/1986 | Montier et al. | 102/517 |
| 4,671,180 | 6/1987 | Wallow et al. | 102/517 |
| 4,671,181 | 6/1987 | Romer et al. | 102/518 |
| 4,716,834 | 1/1988 | Wallow et al. | 102/519 |
| 4,841,868 | 6/1989 | Jackson | 102/517 |
| 4,854,242 | 8/1989 | Katzmann | 102/517 |
| 5,020,439 | 6/1991 | Winter et al. | 102/518 |

FOREIGN PATENT DOCUMENTS

| | | | |
|---|---|---|---|
| 6708676 | 1/1968 | Netherlands | 102/517 |

*Primary Examiner*—Harold J. Tudor
*Attorney, Agent, or Firm*—John R. Wahl

[57] ABSTRACT

A reinforced sub-caliber kinetic energy penetrator comprises an elongated solid cylindrical hard metal body having a plurality of circumferential channels in said surface of said body. A plurality of circumferential reinforcing bands are swaged into the channels in the body to mechanically interlock the bands and said body together. The reinforcing bands stiffen the penetrator during impact with a target at oblique angles and enhance the target penetration and after armor effects.

11 Claims, 1 Drawing Sheet

LONG ROD PENETRATOR

BACKGROUND OF THE INVENTION

1. Field of the Invention

This invention relates generally to armor piercing projectiles, and more particularly, to a reinforced long rod penetrator.

2. Description of the Related Art

Armor-penetrating long rod penetrators made of tungsten or other hard material generally tend to be brittle and fracture readily upon hitting a target armor at an oblique angle. Thus, the more oblique the attack angle, the more tendency there is to shattering of the long rod and therefore the smaller the probability of target armor penetration.

Various attempts have been made to reinforce long rod penetrator projectiles. One reinforced projectile is disclosed in U.S. Pat. No. 4,671,180 to Wallow et al. This penetrator projectile has a central threaded connecting bolt between a nose and the main body of the penetrator and a plurality of funnel-shaped reinforcing elements stacked on the bolt. The main body of the penetrator via the bolt, pre-stressing the funnel-shaped elements therebetween. Upon impact, the funnel-shaped elements tend to enlarge the penetration hole or channel so that the following main penetrator body is not hindered in its penetration. This design does not, however, reinforce the main penetrator body itself.

Another reinforced armor penetrating projectile is disclosed in U.S. Pat. No. 4,616,569 to Montier et al. This patent discloses a high density tubular penetrator body with a central through bore containing a tightly held bundle of core wires, having a greater strength than the tubular portion. THe core wires are in tight radial contact with the the tubular penetrator portion. This design is intended to strengthen the tubular penetrator body but dos not affect the performance against a target at high obliquity.

U.S. Pat. No. 4,854,242 to Katzmann discloses a subcaliber penetrator having a tubular, hard brittle core fastened between two end pieces by a tie rod. This tie rod compresses the brittle penetrator between the end pieces to pre-stress the intermediate component in order to maintain penetrator integrity during initial target penetration.

One further reinforced rod penetrator is disclosed in U.S. Pat. No. 4,841,868 to Jackson. This patent discloses a composite long rod penetrator made of depleted uranium and titanium reinforced with 45% by volume of tungsten wire filaments, having a longitudinally hardness ingredient as a result of varying the volume percent of the reinforcing filaments within the depleted uranium/titanium rod.

All of these approaches are generally complex approaches to enhancing the penetrating capability of rod shaped penetrators. In addition, none improve the high obliquity response of the penetrator. Accordingly there continues to be a need for a simple reinforcement solution for long rod penetrators to enhance penetration and performance at large oblique attack angles against armored targets.

SUMMARY OF THE INVENTION

The basic concept of the invention is to strengthen i.e. reinforce a segmented rod penetrator which has increased effectiveness against near zero obliquity armor targets such that it can be launched at very high velocity, it exhibits the least possible velocity decay during flight and will be effective against oblique armor targets. At the same time, the penetrator in accordance with the invention may advantageously provide pyrophoric effects.

The long rod penetrator in accordance with the present invention is a reinforced segmented long rod penetrator having a length to diameter ratio of greater than at least 15 and a plurality of axially spaced peripheral bands of a high stress material swaged into channels in the surface of the long rod penetrator. More particularly, the long rod penetrator of the invention is a subcaliber saboted long rod penetrator comprising an elongated, solid cylindrical hard body, typically made of tungsten, a tungsten alloy, or depleted uranium which has a plurality of circumferential channels in the surface of the body. These channels are axially spaced from one another creating spaced full diameter segments. A plurality of circumferential reinforcing bands are swaged into the channels. These bands are preferably generally trapezoidal in radial cross section and are mechanically interlocked to the channel walls during the swaging operation. The swaging operation presses the bands into the channel walls so that the outer diameter of the bands is the same as the full diameter of the penetrator body so as create a uniform outer surface to the body.

The outer surface is typically grooved or threaded to provide for secure engagement with corresponding threads or ledges on the discarding sabot to preclude relative axial movement between the sabot and penetrator so that during acceleration of the projectile in the gun barrel, the sabot and penetrator move down the gun bore as one body. These grooves or threads may be created during the swaging operation or machined in a separate operation.

The reinforcing bands are preferably made of sintered zirconium swaged in place. The swaging operation produces the desired strength in the zirconium so that when the long rod penetrator impacts with the target at an oblique angle, such as about 75°, the tendency of the penetrator to split into longitudinally fragments is prevented. Thus these circumferential reinforcing bands improve the stiffness of the penetrator and hence the effectiveness of the penetrator when attacking targets at an oblique angle.

DETAILED DESCRIPTION OF THE INVENTION

Figure 1:
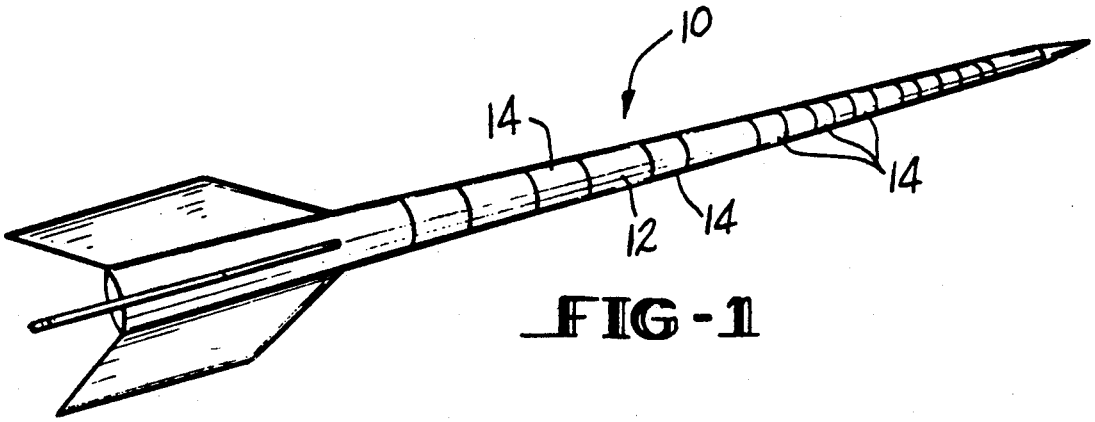
FIG. 1 is a side perspective view of a long rod penetrator in accordance with the invention.
Figure 2:
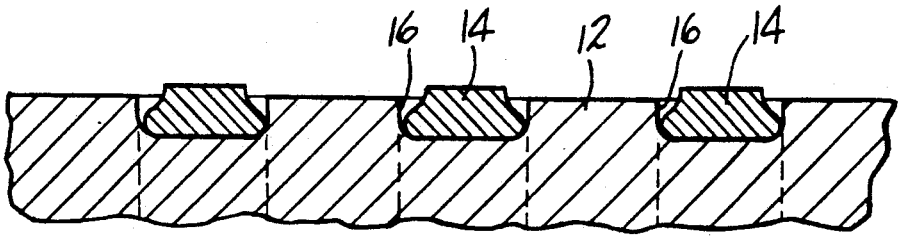
FIG. 2 is a partial longitudinal sectional view of a long rod penetrator prior to swaging of the reinforcing bands into the circumferential channels in the penetrator body.
Figure 3:
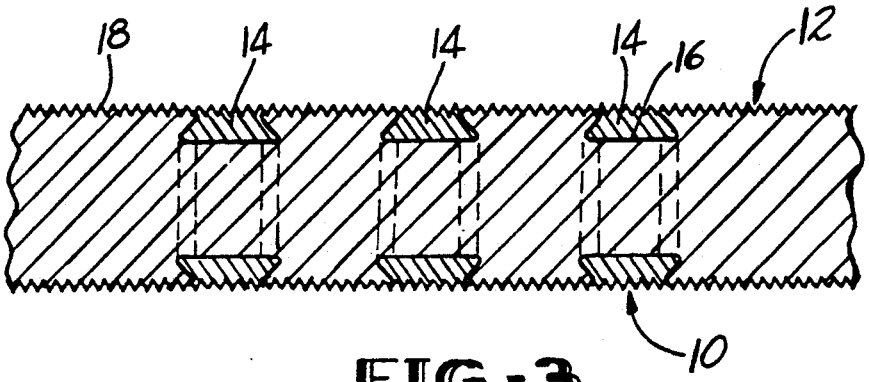
FIG. 3 is a partial longitudinal sectional view of the penetrator in accordance with the present invention shown in FIG. 1.

A long rod rod penetrator projectile 10 in accordance with the present invention is illustrated in FIG. 1. Penetrator 10 is primarily elongated cylindrical body 12 preferably made of tungsten, depleted uranium, or other hard metal material and has a length to diameter ratio of 15 or more. A plurality of swaged-in-place bands 14 of reinforcing materials such as sintered zirconium, steel, titanium, or magnesium are axially spaced along the body 12. These reinforcing bands 14 are disposed in circumferential channels 16 which are machined into the outside surface of the penetrator body 12 as shown in FIG. 2.

Each of the reinforcing bands 14 has a generally trapezoidal cross-sectional shape with its wider base side abutting the bottom surface of the channel 16. The height of the band, i.e. its thickness, is slightly greater than the depth of the channel 16 so that when the reinforcing band 14 is swaged into the penetrator body 12, the swaging operation causes the bottom of the band to spread or flow outward, the non-parallel sides to spread, and the tops of the channel side walls to deform toward each other so as to grip the non-parallel sides of the channel to mechanically interlock the band in place. This swaging operation also strengthens the band material. The result is a substantially improved strength and stiffness to the overall long rod penetrator 10. Further, the bands are arranged in place so as to provide a uniform surface diameter of the penetrator to minimize drag during flight and support uniform circumferential surface grooves or threads 18 in both the outer surface of the body and the bands. These threads or grooves 18 engage corresponding grooves on a sabot to provide uniform and efficient force transfer between the sabot and the penetrator during acceleration.

Proper choice of the composition of the band can result in optimized reduction of the adiabatic shear strength properties of the penetrator such that a smaller hole in the target is produced upon impact. This in turn means that more of the penetrator body passes through the target armor so as to increase after armor effects. Utilization of sintered zirconium or magnesium has another added benefit in addition to reinforcing the tungsten penetrator. These materials are pyrophoric and as such, ignite and burn fiercely. Ignition takes place during the penetration process due to the heat generated by the large rate of plastic deformation, hence further increasing the after armor effects when complete armor penetration is achieved. Alternatively, carbon steel or a suitable alloy steel may also be used for the reinforcing band material. However, the use of such an alloy steel would not result in increased after armor effects due to burning material, as steel is not pyrophoric.

The axially spaced channels 16 in effect create a unitary segmented penetrator 10 that has alternating full diameter hard portions and small diameter hard portions beneath the bands 14. During target armor impact, the penetrator 10 presents spaced large diameter hard masses sequentially impacting against the target armor. The effect of this is to repetitively "hammer" penetrator material into the target. This repetitious hammer effect increases the achievable penetration depth as each time the kinetic energy of a full diameter segment is fully dissipated in the target, another segment hits the target, further penetrating beyond the hole previously created.

The spacing between the channels is critical to this effect. The space must be large enough so that essentially all of the kinetic energy of the impacting full diameter segment is absorbed in the target before the next segment impacts the target. This spacing is less than a full penetrator diameter (D) and should be between about 0.5D and 0.95D. However, the exact spacing should be varied to achieve an optimum and is most optimally chosen dependent upon the dynamic characteristics of the projectile, such as the gun pressures, overall projectile mass, launch acceleration and drag, and the intended target armor material.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A sub-caliber kinetic energy penetrator providing improved target penetration through repetition hammering impacts comprising a one piece elongated solid hard metal body having a generally cylindrical outer surface and a plurality of axially spaced, circumferential annular channels in said generally cylindrical outer surface of said body, along at least a front portion of said body, dividing said surface of said portion of said body into spaced axial segments, each of said channels containing a circumferential reinforcing band mechanically interlocked with said body.

2. The penetrator according to claim 1 wherein said bands are sintered zirconium.

3. The penetrator according to claim 1 wherein said body is tungsten.

4. The penetrator according to claim 1 wherein said bands are titanium.

5. The penetrator according to claim 1 wherein said bands are steel.

6. The penetrator according to claim 1 wherein said bands are magnesium.

7. The penetrator according to claim 3 wherein said bands are sintered zirconium.

8. The penetrator according to claim 1 wherein said bands each have a generally trapezoidal cross sectional shape.

9. The penetrator according to claim 1 wherein said bands are made of a pyrophoric material.

10. The penetrator according to claim 1 wherein said body and said bands have the same outer diameter so as to form a uniform outer surface on said penetrator.

11. The penetrator according to claim 10 wherein said outer surface is threaded.

* * * * *